US009472355B2

(12) United States Patent
Hosono et al.

(10) Patent No.: US 9,472,355 B2
(45) Date of Patent: Oct. 18, 2016

(54) OSCILLATOR-TYPE SWITCH

(71) Applicant: ALPS ELECTRIC CO., LTD., Tokyo (JP)

(72) Inventors: Kunio Hosono, Miyagi-ken (JP); Masahiro Takata, Miyagi-ken (JP); Takahiro Murakami, Miyagi-ken (JP)

(73) Assignee: ALPS ELECTRIC CO., LTD., Tokyo (JP)

( * ) Notice: Subject to any disclaimer, the term of this patent is extended or adjusted under 35 U.S.C. 154(b) by 94 days.

(21) Appl. No.: 14/608,953

(22) Filed: Jan. 29, 2015

(65) Prior Publication Data

US 2015/0221454 A1 Aug. 6, 2015

(30) Foreign Application Priority Data

Feb. 5, 2014 (JP) ..... 2014-020448

(51) Int. Cl.
*H01H 21/24* (2006.01)
*H01H 1/26* (2006.01)
*H01H 3/12* (2006.01)

(52) U.S. Cl.
CPC ..... *H01H 1/26* (2013.01); *H01H 3/12* (2013.01); *H01H 2215/006* (2013.01); *H01H 2221/016* (2013.01)

(58) Field of Classification Search
CPC ..... H01H 1/26; H01H 3/12; H01H 23/205; H01H 2227/004; H01H 2221/002; H01H 2235/002
USPC ..... 200/557, 342–344, 512, 513, 516
See application file for complete search history.

(56) References Cited

U.S. PATENT DOCUMENTS 4,430,531 A * 2/1984 Wright ..... H01H 13/7006 200/275
5,874,697 A * 2/1999 Selker ..... H01H 13/705 200/343
6,392,179 B1 * 5/2002 Schwarzbich ..... D06F 39/005 200/341
6,940,030 B2 * 9/2005 Takeda ..... H01H 13/705 200/343
7,381,919 B1 * 6/2008 Yu ..... H01H 21/24 200/296
7,635,821 B2 * 12/2009 Hamada ..... H01H 9/0235 200/293
7,829,810 B2 * 11/2010 Nakajima ..... H01H 13/705 200/333
2001/0047927 A1 * 12/2001 Ogawa ..... H01H 13/70 200/343
2004/0129547 A1 * 7/2004 Tomitsuka ..... H01H 13/7006 200/513
2004/0195082 A1 * 10/2004 Takeda ..... H01H 13/705 200/343
2015/0221454 A1 * 8/2015 Hosono ..... H01H 3/12 200/557

FOREIGN PATENT DOCUMENTS

JP 2012-033429 2/2012

* cited by examiner

*Primary Examiner* — Kyung Lee
(74) *Attorney, Agent, or Firm* — Brinks Gilson & Lione

(57) ABSTRACT

An oscillator-type switch includes a base, an elastic member mounted on the base and flexible in an up-down direction, an oscillation member having a base portion mounted on the elastic member and a driving section connected from the base portion in a first horizontal direction along an upper surface of the base, a key top set on the oscillation member, a reversal spring applying a reaction force to a downward movement of the driving section, and a pressure-sensitive switch sheet detecting the downward movement of the driving section. The elastic member is arranged for a center line in the first horizontal direction within a range in which the elastic member is mounted on the oscillation member to be positioned outside a projection area of the operation unit in the first horizontal direction.

8 Claims, 5 Drawing Sheets

OSCILLATOR-TYPE SWITCH

CLAIM OF PRIORITY

This application claims benefit of priority to Japanese Patent Application No. 2014-020448 filed on Feb. 5, 2014, which is hereby incorporated by reference in its entirety.

BACKGROUND

1. Field of the Disclosure

The present disclosure relates to an oscillator-type switch.

2. Description of the Related Art

FIG. 5 illustrates a schematic redrawing of an oscillator-type switch that is illustrated in FIG. 7 of Japanese Unexamined Patent Application Publication No. 2012-33429. An elastic member 32 mounted on a base 31 and flexible in an up-down direction, an oscillation member 33 mounted on the elastic member 32, an operation unit 34 set on the oscillation member, and a switch element 35 constitute the oscillator-type switch according to Japanese Unexamined Patent Application Publication No. 2012-33429. This oscillator-type switch can be compact in size.

However, in a case where a fixed end side end portion 34*a* of the operation unit 34 is pressed as indicated by the arrow in FIG. 5 and as illustrated in FIG. 5, a reverse-direction rotational moment is generated and a switch operation becomes impossible.

SUMMARY

An oscillator-type switch according to a first aspect includes a base, an elastic member mounted on the base and flexible in an up-down direction, an oscillation member having a base portion mounted on the elastic member and a driving section connected from the base portion in a first horizontal direction along an upper surface of the base, an operation unit set on the oscillation member, a reaction force application member that applies a reaction force to a downward movement of the driving section, and a detector that detects the downward movement of the driving section, in which the elastic member is arranged for a center line in the first horizontal direction within a range in which the elastic member is mounted on the oscillation member to be positioned outside a projection area of the operation unit in the first horizontal direction.

According to the oscillator-type switch of the first aspect, a direction of a rotational moment is the same as when the vicinity of the center of the operation unit is pressed even when a fixed end side end portion of the operation unit is pressed. Accordingly, a switch operation can be stably performed no matter which position of the operation unit is pressed.

DESCRIPTION OF THE EXEMPLARY EMBODIMENTS

Figure 1:
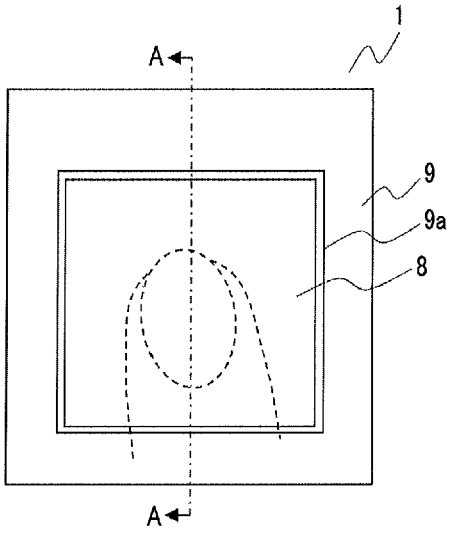
FIG. 1 is a top view of an oscillator-type switch according to a first embodiment.

A structure of an oscillator-type switch 1 according to a first embodiment will be described with reference to FIGS. 1 to 3. FIG. 1 is a top view of the oscillator-type switch 1. Viewed from an upper surface, the oscillator-type switch 1 is provided with a frame body 9 that has an opening 9*a* and a key top 8 (operation unit) that is housed in the opening 9*a*. The key top 8 is subjected to a pressing operation by a finger that is illustrated by a dashed line.

Figure 2:
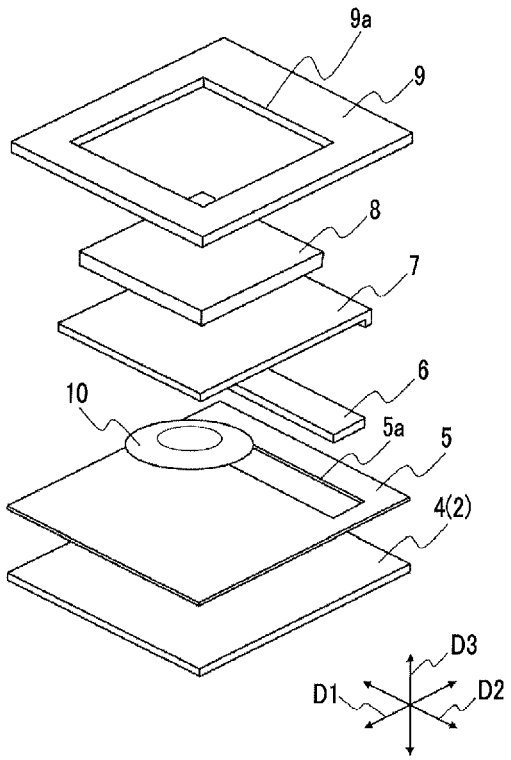
FIG. 2 is an exploded perspective view of the oscillator-type switch according to the first embodiment.
Figure 3:
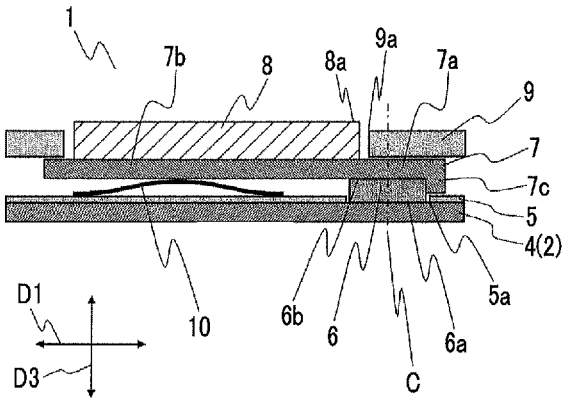
FIG. 3 is a cross-sectional view of the oscillator-type switch according to the first embodiment taken along line III-III.

FIG. 2 is an exploded perspective view of the oscillator-type switch 1. FIG. 3 is a cross-sectional view of the oscillator-type switch 1 taken along line III-III. A lowermost portion of the oscillator-type switch 1 is provided with a lower side substrate 4, and a pressure-sensitive switch sheet 5 (detection means) is placed on the lower side substrate 4. Herein, the lower side substrate 4 is a base. A membrane switch sheet, in which, for example, a lower fixed contact sheet, a spacer sheet, and an upper movable contact sheet are configured to be stacked in order, or the like constitutes the pressure-sensitive switch sheet 5. An elastic member 6 is mounted on the lower side substrate 4. A through-hole 5*a* is formed at a position of the pressure-sensitive switch sheet 5 corresponding to the elastic member 6 so that the elastic member 6 and the pressure-sensitive switch sheet do not interfere with each other. A material such as rubber and sponge constitutes the elastic member 6. An adhesive substance is applied to a lower surface 6*a* of the elastic member 6. The lower surface 6*a* is fixed to an upper surface of the lower side substrate 4. An adhesive substance is also applied to an upper surface 6*b* of the elastic member 6, and a lower surface of a base portion 7*a* of an oscillation member 7 that is arranged on the elastic member 6 is fixed to the upper surface 6*b* of the elastic member 6. A metal plate made of stainless steel or the like constitutes the oscillation member 7. A fixed end side of the oscillation member 7 is the base portion 7*a*, and a part of the oscillation member 7 that is laterally connected from the base portion 7*a* in a first horizontal direction D1 along the upper surface of the lower side substrate 4 is a driving section 7*b* on a free end side. A ridge portion 7*c* that is formed to be bent downward is disposed in an edge portion of the oscillation member 7 on the base portion 7*a* side. The key top 8 is fixed onto the driving section 7*b* of the oscillation member 7. The frame body 9 is arranged on the oscillation member 7 for the opening 9*a* to surround the key top 8. A reversal spring 10 is arranged in the vicinity of the center of the key top 8 and between the driving section 7*b* of the oscillation member 7 and the pressure-sensitive switch sheet 5. The reversal spring 10 functions as a reaction force application member that applies a reaction force and applies a click feeling when the driving section 7*b* of the oscillation member 7 is moved downward. The reversal spring 10 may comprise a metallic material such as stainless steel.

Next, an operation of the oscillator-type switch 1 according to the first embodiment will be described. When an operator performs the pressing operation with the finger on the vicinity of the center of the key top 8, the oscillation member 7 oscillates on a center line C of the elastic member 6 in the first horizontal direction D1 as a fulcrum that is within a range in which the elastic member 6 is mounted on the oscillation member 7, and the driving section 7*b* is moved downward. Then, the reversal spring 10 applies the reaction force and applies the click feeling to the driving section 7*b*. Then, a central portion of the reversal spring 10 presses the pressure-sensitive switch sheet 5 so that the pressing operation is detected.

Next, an effect of the first embodiment will be described. In the first embodiment, the elastic member 6 is arranged for the center line C in the first horizontal direction D1 within the range in which the elastic member 6 is mounted on the oscillation member 7, that is, within the range of the upper surface 6*b* in close contact with the oscillation member 7, to be positioned outside a projection area of the key top 8 in the first horizontal direction D1, that is, outside a fixed end side end portion 8*a* of the key top 8. Accordingly, even when the fixed end side end portion 8*a* of the key top 8 is pressed, a direction of a rotational moment is the same as when the vicinity of the center of the key top 8 is pressed. Accordingly, a switch operation can be stably performed no matter which position of the key top 8 is pressed.

In the first embodiment, the oscillation member 7 is provided with the ridge portion 7*c* that protrudes downward from the edge portion on the base portion side in the first horizontal direction D1 and extends in a second horizontal direction D2 which is parallel to the upper surface of the lower side substrate 4 and is orthogonal to the first horizontal direction D1. Accordingly, rigidity of the oscillation member 7 can be high, and deflection of the oscillation member 7 can be suppressed when an end portion of the key top 8, particularly the vicinity of the edge portion in the second horizontal direction D2, is pressed. Accordingly, the switch operation can be stably performed.

The ridge portion 7*c* can also be disposed in a place other than the base portion side but a stroke of the oscillation member 7 may not be ensured in this case. In addition, the ridge portion 7*c* may be allowed to protrude upward but design of the oscillation member 7 may be degraded in this case. In the first embodiment, however, the ridge portion 7*c* protrudes on the base portion side and downward, and thus the stroke and the design of the oscillation member 7 are not affected. In a case where the ridge portion 7*c* protrudes on the base portion side and downward, the elastic member 6 may be allowed to abut against a side surface of the ridge portion 7*c* so that the elastic member 6 and the ridge portion 7*c* can be positioned with respect to each other while being used.

In the first embodiment, the metal plate made of stainless steel or the like constitutes the oscillation member 7, a metallic reversal spring made of stainless steel or the like constitutes the reversal spring 10, and the metallic reversal spring is arranged under the metal plate so that the metallic reversal spring and the metal plate are in direct contact with each other. In this case, the high-rigidity oscillation member 7 is in direct contact with the high-rigidity reversal spring 10, and thus thickness reduction and a comfortable click feeling can be achieved.

In the first embodiment, it is preferable that the operator operates at a position where the finger is directed toward the elastic member 6 from the reversal spring 10 as illustrated in FIG. 1 and a cross-sectional view of FIG. 1 taken along line III-III. This is because a finger contact area is likely to be a ventral side of the finger rather than a fingertip, due to an angle between the finger and a key top surface, in a case where the key top 8 is subjected to the pressing operation and an operation load is likely to be suppressed by a natural operation and the click feeling can be stably achieved when the ventral side of the finger is arranged in a direction away from the elastic member that is the oscillation fulcrum.

Figure 4:
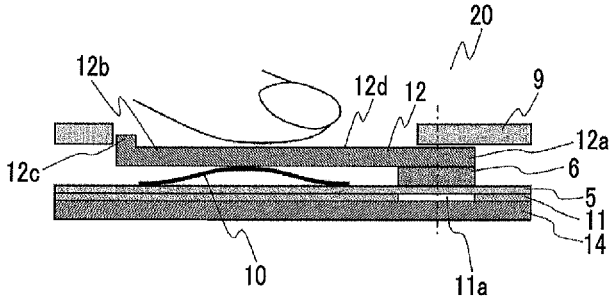
FIG. 4 is a cross-sectional view of an oscillator-type switch according to a second embodiment.
Figure 5:
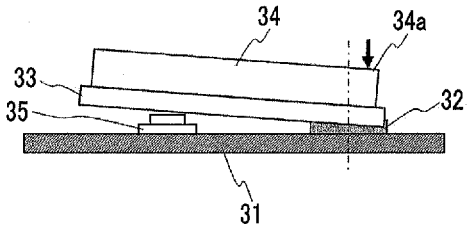
FIG. 5 is a view showing a problem of the related art.

Next, an oscillator-type switch 20 according to a second embodiment will be described with reference to FIG. 4. Like reference numerals will used to indicate like parts in the first embodiment and description thereof will be omitted. FIG. 4 is a cross-sectional view of the oscillator-type switch 20 according to the second embodiment. In the oscillator-type switch 20, three components, the lower side substrate 4, the pressure-sensitive switch sheet 5, and an intermediate sheet 11 that is interposed between the lower side substrate 4 and the pressure-sensitive switch sheet 5 to be exact, constitute the base. In the intermediate sheet 11, an opening section 11*a* is formed at a position under the pressure-sensitive switch sheet 5 and corresponding to the elastic member 6. The pressure-sensitive switch sheet 5 functions as a flexible sheet. The opening section 11*a* functions as a concave portion that is formed at a position under the flexible sheet and corresponding to the elastic member 6.

According to this configuration, the elastic member 6 is displaced downward when a position close to the oscillation fulcrum (center line C of the elastic member 6 herein) is subjected to the pressing operation. Accordingly, a difference between the stroke and the operation load occurring when a position far away from the oscillation fulcrum is pressed and the stroke and the operation load occurring when the position close to the oscillation fulcrum is pressed decreases, and a difference between operation feelings attributable to the pressing operation can be decreased.

In the second embodiment, the key top 8 is not disposed, the pressing operation is directly performed on an oscillation member 12, and a part that is exposed from the opening 9*a* of the frame body 9 is set as an operation surface 12*d*. In addition, a ridge portion 12*c* protrudes upward to an edge portion on a driving section 12*b* side.

A plurality of the oscillator-type switches according to the present invention may be arranged as a key input device such as a keyboard. In this case, a stable input operation can be performed no matter which position of the operation unit is operated. In this case, the base may be a common base and individual members such as the oscillation members, the elastic members, and the reaction force application members may be formed on the common base. If directions of the elastic members are aligned with respect to the reaction force application members of the plurality of oscillator-type switches in this case, the difference in operation load and click feeling attributable to the pressing operation can be suppressed for each of the operation units.

The present invention is not limited to the embodiments described above, and various modifications can be added thereto without departing from the scope of the present invention. For example, the oscillation member 7 and the reversal spring 10 are formed by using a metal, but may also be formed by using a resin or the like without having to be limited thereto. In addition, the ridge portion 7*c* is disposed in the oscillation member 7, but the ridge portion 7*c* may also be omitted in a case where, for example, the oscillation member 7 has a sufficient rigidity.

It should be understood by those skilled in the art that various modifications, combinations, sub-combinations and alterations may occur depending on design requirements and other factors insofar as they are within the scope of the appended claims of the equivalents thereof.

What is claimed is:

1. An oscillator-type switch comprising:

a base;

an elastic member mounted on the base and flexible in an up-down direction;

a metal plate that constitutes an oscillation member that includes a base portion mounted on the elastic member and a driving section connected from the base portion in a first horizontal direction along an upper surface of the base;

an operation unit that sets on the oscillation member;

a metallic reversal spring that constitutes a reaction force application member that applies a reaction force to a downward movement of the driving section; and a detector that detects the downward movement of the driving section;

wherein the elastic member is arranged for a center line in the first horizontal direction within a range in which the elastic member is mounted on the oscillation member to be positioned outside a projection area of the operation unit in the first horizontal direction; and wherein the metallic reversal spring is arranged under the metal plate so that the metallic reversal spring and the metal plate are in direct contact with each other.

2. The oscillator-type switch according to claim 1, wherein the oscillation member further includes a ridge portion that protrudes in the up-down direction and extends in a horizontal direction in an edge portion in the horizontal direction.

3. The oscillator-type switch according to claim 2, wherein the oscillation member further includes a ridge portion that protrudes downward and extends in a second horizontal direction orthogonal to the first horizontal direction in an edge portion on the base portion side in the first horizontal direction.

4. The oscillator-type switch according to claim 1, wherein the base includes a flexible sheet arranged under the elastic member and includes a concave portion at a position under the flexible sheet and corresponding to the elastic member.

5. An oscillator-type switch comprising:

a base;

an elastic member mounted on the base and flexible in an up-down direction;

an oscillation member that includes a base portion mounted on the elastic member and a driving section connected from the base portion in a first horizontal direction along an upper surface of the base;

an operation unit that sets on the oscillation member;

a reaction force application member that applies a reaction force to a downward movement of the driving section; and a detector that detects the downward movement of the driving section, wherein the detector comprises a pressure-sensitive switch sheet and includes a through-hole where the elastic member can be arranged; and wherein the elastic member is arranged for a center line in the first horizontal direction within a range in which the elastic member is mounted on the oscillation member to be positioned outside a projection area of the operation unit in the first horizontal direction.

6. The oscillator-type switch according to claim 5, wherein the oscillation member further includes a ridge portion that protrudes in the up-down direction and extends in a horizontal direction in an edge portion in the horizontal direction.

7. The oscillator-type switch according to claim 6, wherein the oscillation member further includes a ridge portion that protrudes downward and extends in a second horizontal direction orthogonal to the first horizontal direction in an edge portion on the base portion side in the first horizontal direction.

8. The oscillator-type switch according to claim 5, wherein the base includes a flexible sheet arranged under the elastic member and includes a concave portion at a position under the flexible sheet and corresponding to the elastic member.

* * * * *